US007261380B2

(12) United States Patent
Ha

(10) Patent No.: US 7,261,380 B2
(45) Date of Patent: Aug. 28, 2007

(54) PELVIS REMEDIAL SEATING DEVICE

(76) Inventor: Jeon Ho Ha, 202-304 Dongsin 2nd Apt., Junghwasan 1-dong, Wansan-gu, Jeonju-city, Jeonbuk 560-251 (KR)

( * ) Notice: Subject to any disclaimer, the term of this patent is extended or adjusted under 35 U.S.C. 154(b) by 168 days.

(21) Appl. No.: 10/526,575

(22) PCT Filed: Aug. 26, 2003

(86) PCT No.: PCT/KR03/01718

§ 371 (c)(1),
(2), (4) Date: Mar. 4, 2005

(87) PCT Pub. No.: WO2004/023970

PCT Pub. Date: Mar. 25, 2004

(65) Prior Publication Data

US 2005/0242639 A1 Nov. 3, 2005

(30) Foreign Application Priority Data

Sep. 10, 2002 (KR) ..... 10-2002-0054445
Jun. 24, 2003 (KR) ..... 10-2003-0041106

(51) Int. Cl.

| | |
|---|---|
| ***A47C 7/14*** | (2006.01) |
| ***A47C 7/02*** | (2006.01) |
| ***A47C 4/54*** | (2006.01) |
| ***A47C 7/54*** | (2006.01) |
| ***A47D 1/10*** | (2006.01) |

(52) U.S. Cl. ..... 297/452.41; 297/219.1; 297/219.12; 297/230.1; 297/230.12; 297/230.13; 297/250.1; 297/256.16; 297/284.6; 297/284.9; 297/411.27; 297/411.37; 297/440.1; 297/440.15

(58) Field of Classification Search ..... 297/452.41, 297/DIG. 3, 219.1, 219.12, 230.1, 230.11, 297/230.12, 230.13, 250.1, 256.16, 284.6, 297/284.9, 440.1, 440.14, 440.15, 411.27, 297/411.37
See application file for complete search history.

(56) References Cited

U.S. PATENT DOCUMENTS

| | | | | |
|---|---|---|---|---|
| 1,974,619 A * | 9/1934 | Lubey | ..... | 297/250.1 X |
| 2,496,205 A * | 1/1950 | Grieb | ..... | 297/250.1 |
| 4,132,228 A * | 1/1979 | Green | ..... | 297/DIG. 3 X |
| 4,145,083 A * | 3/1979 | Urban | ..... | 297/DIG. 3 X |
| 4,518,200 A * | 5/1985 | Armstrong | ..... | 297/284.6 |

(Continued)

FOREIGN PATENT DOCUMENTS

JP 10 118143 A 5/1998

(Continued)

*Primary Examiner*—Rodney B. White
(74) *Attorney, Agent, or Firm*—JHK Law; Joseph Hyosuk Kim

(57) ABSTRACT

A pelvis remedial seating device is provided having a seat including a seat cushion on which an occupant is to be seated and left/right seat sides provided uprightly at each side end of the seat cushion; a pair of air bags nested to a height of the pelvis portion of an occupant on an inner side of each side for enabling themselves to be expanded or contracted by air supplied into or discharged from the inside of the air bag; air injector for providing air pressure to the air bags; and a controller for controlling running time, level, and direction of air flow supplied through the air injection means, wherein the expanding air pressure in the air bags presses the pelvis portion of an occupant.

16 Claims, 14 Drawing Sheets

U.S. PATENT DOCUMENTS 4,552,402 A * 11/1985 Huber et al. ..... 297/284.6
4,592,588 A * 6/1986 Isono et al. ..... 297/284.6
4,634,083 A * 1/1987 McKinnon ..... 297/284.6 X
4,634,179 A * 1/1987 Hashimoto et al. ..... 297/284.6
4,643,481 A * 2/1987 Saloff et al. ..... 297/452.41 X
4,655,505 A * 4/1987 Kashiwamura et al. .. 297/284.6
4,699,424 A * 10/1987 Andres et al. ..... 297/284.6
4,722,550 A * 2/1988 Imaoka et al. ..... 297/DIG. 3 X
4,759,543 A * 7/1988 Feldman ..... 297/284.6 X
4,781,413 A * 11/1988 Shumack, Jr. ..... 297/230.1 X
4,830,432 A * 5/1989 Fuhrmann et al. . 297/DIG. 3 X
4,833,614 A * 5/1989 Saitoh et al. ..... 297/284.6 X
4,842,330 A * 6/1989 Jay ..... 297/DIG. 3 X
4,854,638 A * 8/1989 Marcus et al. ..... 297/440.15 X
4,912,788 A * 4/1990 Lonardo ..... 297/230.13 X
5,005,904 A * 4/1991 Clemens et al. ..... 297/284.6
5,123,699 A * 6/1992 Warburton ..... 297/219.1
5,125,121 A * 6/1992 Wroble ..... 297/219.1 X
5,127,708 A * 7/1992 Kishi et al. ..... 297/284.6 X
5,129,704 A * 7/1992 Kishi et al. ..... 297/284.6 X
5,155,685 A 10/1992 Kishi et al.
5,251,957 A * 10/1993 Lemens ..... 297/230.1
5,263,765 A * 11/1993 Nagashima et al. ..... 297/284.6
5,314,235 A * 5/1994 Johnson ..... 297/452.41 X
5,320,409 A * 6/1994 Katoh et al. ..... 297/284.6
5,338,133 A * 8/1994 Tornero ..... 297/411.37 X
5,360,360 A * 11/1994 Peterson ..... 297/DIG. 3 X
5,372,405 A * 12/1994 Cash et al. ..... 297/219.12 X
5,419,617 A * 5/1995 Schultz ..... 297/411.27
5,461,741 A * 10/1995 Graebe ..... 297/452.41 X
5,496,092 A * 3/1996 Williams et al. ..... 297/250.1
5,551,749 A * 9/1996 Reher et al. ..... 297/219.12
5,609,389 A * 3/1997 Longoria et al. .... 297/250.1 X
5,642,917 A * 7/1997 Geiger ..... 297/219.1 X
5,660,442 A * 8/1997 Tornero ..... 297/411.37 X
5,839,784 A * 11/1998 Breen ..... 297/411.37 X
6,098,000 A * 8/2000 Long et al. ..... 297/284.6 X
6,203,105 B1 * 3/2001 Rhodes, Jr. ..... 297/284.6
6,209,962 B1 * 4/2001 Sobel et al. ..... 297/452.41 X
6,378,947 B1 * 4/2002 Barber et al. ..... 297/284.9 X
6,496,994 B1 * 12/2002 Omel et al. ..... 297/284.6 X
6,659,553 B2 * 12/2003 Achleitner et al. ..... 297/284.9
6,679,557 B2 * 1/2004 Craft et al. ..... 297/452.41
6,682,059 B1 * 1/2004 Daniels et al. ..... 297/284.6 X
6,767,060 B2 * 7/2004 Craft et al. ..... 297/284.6 X
6,832,813 B2 * 12/2004 Tomas et al. ..... 297/250.1
6,840,577 B2 * 1/2005 Watkins ..... 297/284.9
2003/0067198 A1 * 4/2003 Treen et al. ..... 297/250.1

FOREIGN PATENT DOCUMENTS

WO WO 01/00132 A2 1/2001

* cited by examiner

PELVIS REMEDIAL SEATING DEVICE

TECHNICAL FIELD

The present invention relates to a pelvis remedial seated device for remedying into its original place a women's widened pelvis after child birth. More particularly, the invention relates to a pelvis remedial seated device and a control method thereof wherein the air pressure can artificially press the pelvis portion of the woman while seated or lying down relaxedly without constraining the human body so that the woman can get into good shape as soon as it possible.

BACKGROUND ART

As a woman grows older, the muscle of her pelvis is gradually weakened with cause of sexual life and child delivery. After the birth, particularly the pelvis muscle, which supports hypogastrium, the bladder, the vagina and the anus, takes a sudden turn for worse.

The typical actual phenomena of the physical process occurred by following is that the pelvis gets wider. With the widened pelvis, the body of the woman loses a balance and it will not be able to maintain a good shape.

Additionally, as the pelvis muscle weakens, the function that controls the bladder decreases. Even when the bladder is full, urinary incontinence can result in spite of oneself.

Another phenomena occurred by pelvis base muscular weakening is that the controllability of the sphincter, which contracts and dilates the vagina and the anus notedly decreases, thus bring an impediment to a married life.

In many conventional arts, a guard belt having a form of a band is disclosed, which is worn on a waist or pelvis portion to support a weaken pelvis muscle. The typical prior technology describing the guard belt is cited in Korean Utility Patent No. 20-0166329.

The conventional guard belt is comprised of an inner band having a plurality of steel balls therein and an outer band covering the inner belt. It anticipates an action and effect such that a press of steel balls supports the articular ligament of the lumbar vertebra.

However, since conventional guard belts described above are worn using a Velcro (an adhesive tape which is substituted for a button: trademark) fastener attached on each free end of the belt, wearing the guard belt cause localized pressure in the human body and induces a pain. It also brings about a hindrance in activity of the body.

Further, as a wearer is doing an action, the tightening force gradually becomes loose and it must be tightened frequently, which brings a cumbersome problem. Furthermore, the inconvenience is brought that the wearer on a pelvis portion could not sit and lie down relaxedly.

Particularly, the conventional belt with its form of band has a weak pressure force and therefore not much effect can be anticipated. When a pelvis is crooked, it has a disadvantage that no appropriate remedy can be achieved.

DISCLOSURE OF THE INVENTION

Accordingly, the present invention has been made with taking the above problems occurring in the prior art into consideration, and an object of the present invention is to provide a pelvis remedial seated device and a control method thereof in which the air pressure can smoothly press the pelvis portion of a woman while seated or lying down relaxedly, with good usability and moderation to the human body, and also a widened pelvis of woman after the birth is returned into its original place so as to maintain a good shape, and further the feminine function decrease and the disease caused by the widened pelvis can effectively be cured.

Another object of the present invention is to provide a pelvis remedial seated device and a control method thereof in which air pressure supplied to respective air bags can be regulated according to human's contour, and the pelvis can be pressed in a predetermined level irrespective of human's contour.

Another object of the present invention is to provide a pelvis remedial seated device and a control method thereof in which front and rear air bags installed at each right and left side can be expanded or contracted crosswise, and a crooked pelvis can be remedied by applying pressure to the pelvis diagonally.

Another object of the present invention is to provide a pelvis remedial seated device and a control method thereof in which air pressure can be applied in various levels and the pelvis can be remedied using various modes such as massage, fumble with pressing, and beat.

In order to accomplish the above object, a pelvis remedial seated device comprises a seat included a seat cushion on which an occupant is to be seated and a left/right seat side provided uprightly at each side end of the seat cushion; a pair of air bags nested on an inner side of each side for enabling themselves to be expanded or contracted by air supplied into or discharged from the inside of the air bag; and air injection means for providing air pressure to the air bags; wherein the expanding air pressure in the air bags presses the pelvis portion of an occupant.

Further, the pair of air bags are comprised of front/rear cells having an individual space; the air injection means is comprised of right/left air pump each connected to the right/left air bag for supplying the air into the front/rear cells, right/left direction control valve for supplying air to all air bags or a selective one, right/left air pressure sensor for detecting the pressure of the air fed into the right/left direction control valve from the right/left air pump, right/left front/rear air discharge valve for discharging the air from the front/rear cells, controller for controlling the air pump, direction control valve and air discharge valve, a display panel for displaying a signal generated from the controller, and a control panel having a plurality of operating keys for inputting the signal generated by a pushed key into the controller.

Furthermore, the seat cushion has further a photo detective sensor, and during no occupant's seating, the photo detective sensor senses the light and the running of the remedial seated device is stopped by the command of the controller.

Further, the seat cushion has further a far-infrared generator, an oscillating motor and a low frequency oscillator controlled by the command of the controller at the contacting portion with an occupant's hip, by which the far-infrared light is applied to a pelvis muscle.

A control method of a pelvis remedial seated device is comprised the steps of:

(A) inputting a value of a press level chosen by an occupant through a control panel;

(B) supplying the air into right/left air bag by operation of right/left air pump;

(C) supplying the air into left front/rear cells and right front/rear cells under the control of right/left direction control valves;

(D) detecting the air pressure in right/left air bags by right/left air pressure sensors, determining whether a detected air pressure is lower than a value inputted by an occupant, returning to step (B) if it is, or stopping a running of the air pump for predetermined period if it is not;

(E) discharging the air through opened right/left front/rear air discharge value until the air pressure of the air bag is lower than a discharge pressure; and, (F) stopping the running of the air pump for predetermined period when the air pressure of the air bag is lower than a discharge pressure, comparing between the present time elapsed from step (A) and the predetermined set time, returning to step (B) if the present time has not passed, or going a stop step if it has.

A control method of the remedial device to remedy a crooked pelvis is comprised the steps of:

(A) inputting a value of a press level chosen and a type of crook remedy by an occupant through a control panel;

(B) supplying the air into right/left air bag by operation of right/left air pump;

(C) supplying the air into left front/rear cells and right front/rear cells under the control of right/left direction control valves;

(D) detecting the air pressure in right/left air bags by right/left air pressure sensors, determining whether a detected air pressure is lower than a value inputted by an occupant, returning to step (B) if it is, or determining whether its next step is a right crook remedy or a left crook remedy if it is not;

(E) discharging the air through a left rear air discharge value and a right front air discharge value until the air pressure of a left rear cell and a right front cell is the appropriated one to support an occupant's pelvis when the left crook remedy;

(F) determining whether the air pressure of the left rear cell and the right front cell is lower than a discharge one, returning to step (E) if it is not, stopping the running of the air pump for predetermined period if it is;

(G) comparing between the present time elapsed from step (A) and the predetermined set time, returning to step (B) if the present time has not passed, or going a stop step if it has;

(H) discharging the air through a left front air discharge value and a right rear air discharge value until the air pressure of a left front cell and a right rear cell is the appropriated one to support an occupant's pelvis when the left crook remedy at step (D); and, (I) determining whether the air pressure of the left front cell and the right rear cell is lower than a discharge one, returning to step (H) if it is, stopping the running of the air pump for predetermined period if it is not, and comparing between the present time elapsed from step (A) and the predetermined set time, returning to step (B) if the present time has not passed, or going a stop step if it has.

BRIEF DESCRIPTION OF THE DRAWINGS

The above and other objects, features and other advantages of the present invention will be more clearly understood from the following detailed description taken in conjunction with the accompanying drawings, in which.

BEST MODE FOR CARRYING OUT THE INVENTION

This invention will be described in further detail by way of exemplary embodiments with reference to the accompanying drawings.

Figure 1A:
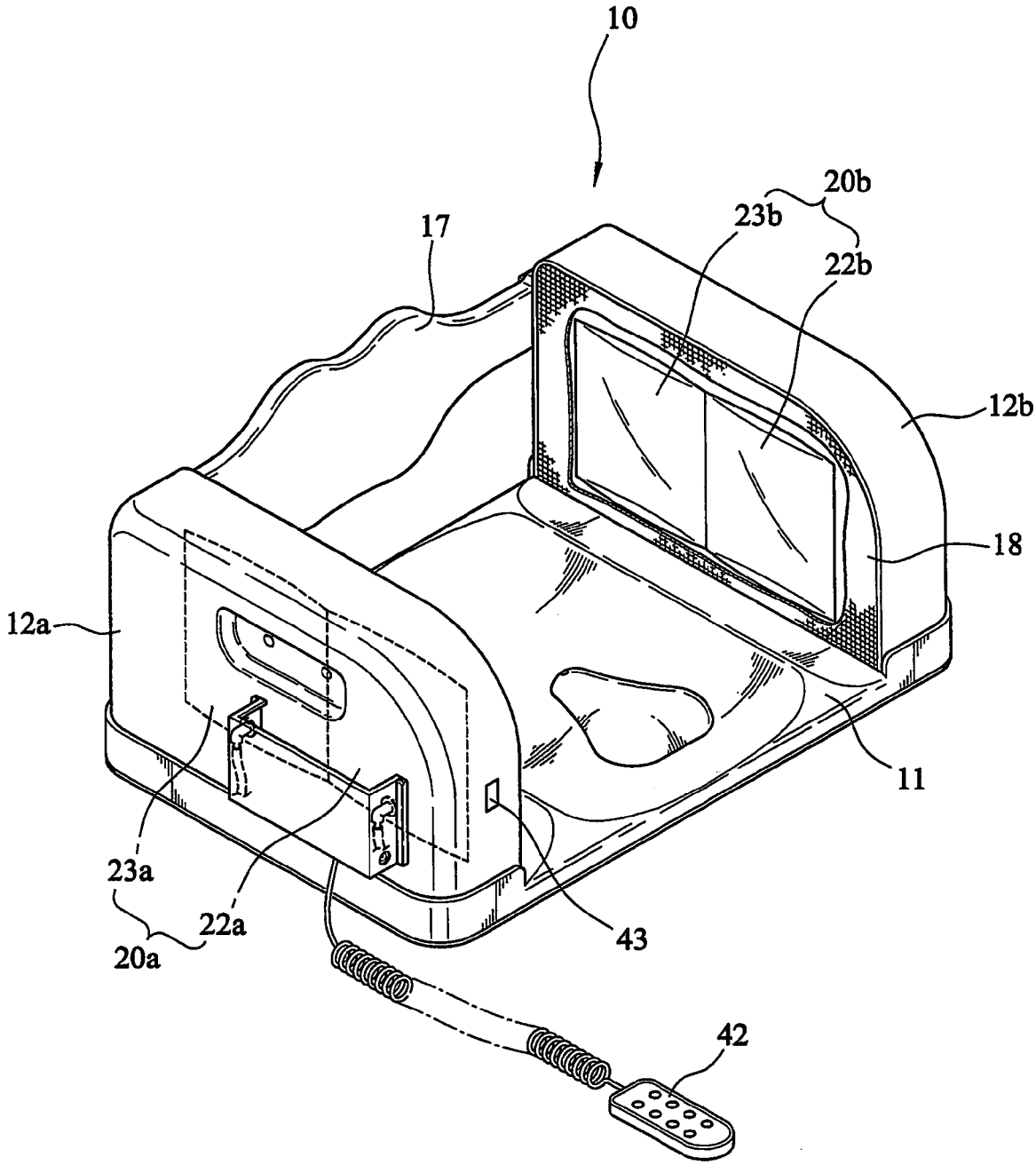
FIG. 1A is a perspective view of a pelvis remedial seated device according to one embodiment of the present invention.
Figure 1B:
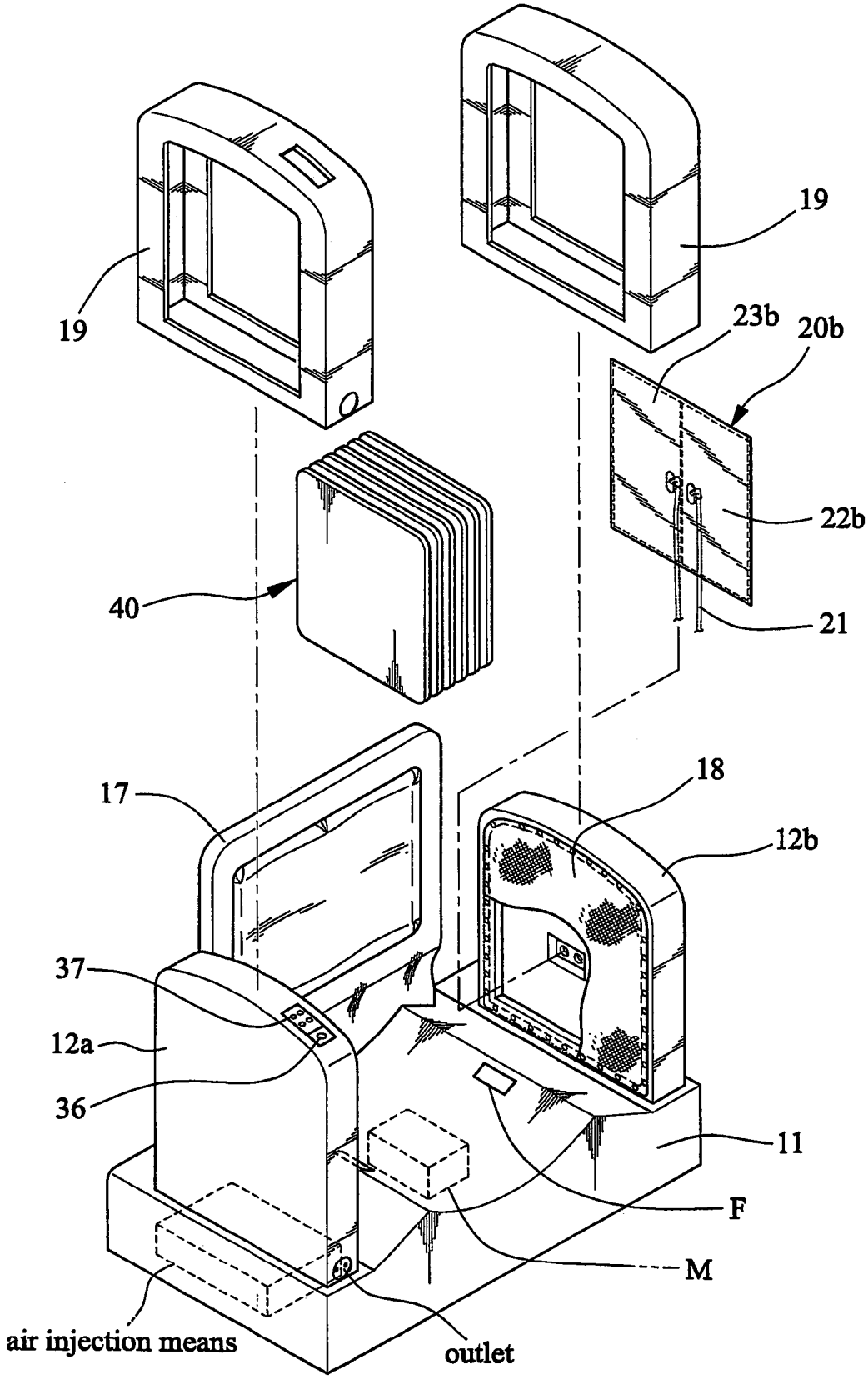
FIG. 1B is a perspective view of a pelvis remedial seated device according to other embodiment of the present invention.

As shown in FIGS. 1A and 1B, the inventive pelvis remedial seated device is fundamentally comprised of a seat 10 on which an occupant's hip rests, a pair of air bags 20*a*, 20*b* nested at an inner side of the seat 10 and air injection means for providing air pressure to the air bags 20*a*, 20*b*. Hereafter, right side of an occupant is designated as "a" and left side of an occupant is designated as "b" for convenience of description.

The seat 10 has a seat cushion 11 on which an occupant is to be seated and right/left seat sides 12*a*, 12*b* provided uprightly at each side end of the seat cushion 11. The right/left seat sides 12*a*, 12*b* maintain the expanding pressure of the air bags 20*a*, 20*b* as an occupant's pelvis portion is pressed by the expanded air bags 20*a*, 20*b*.

Figure 2:
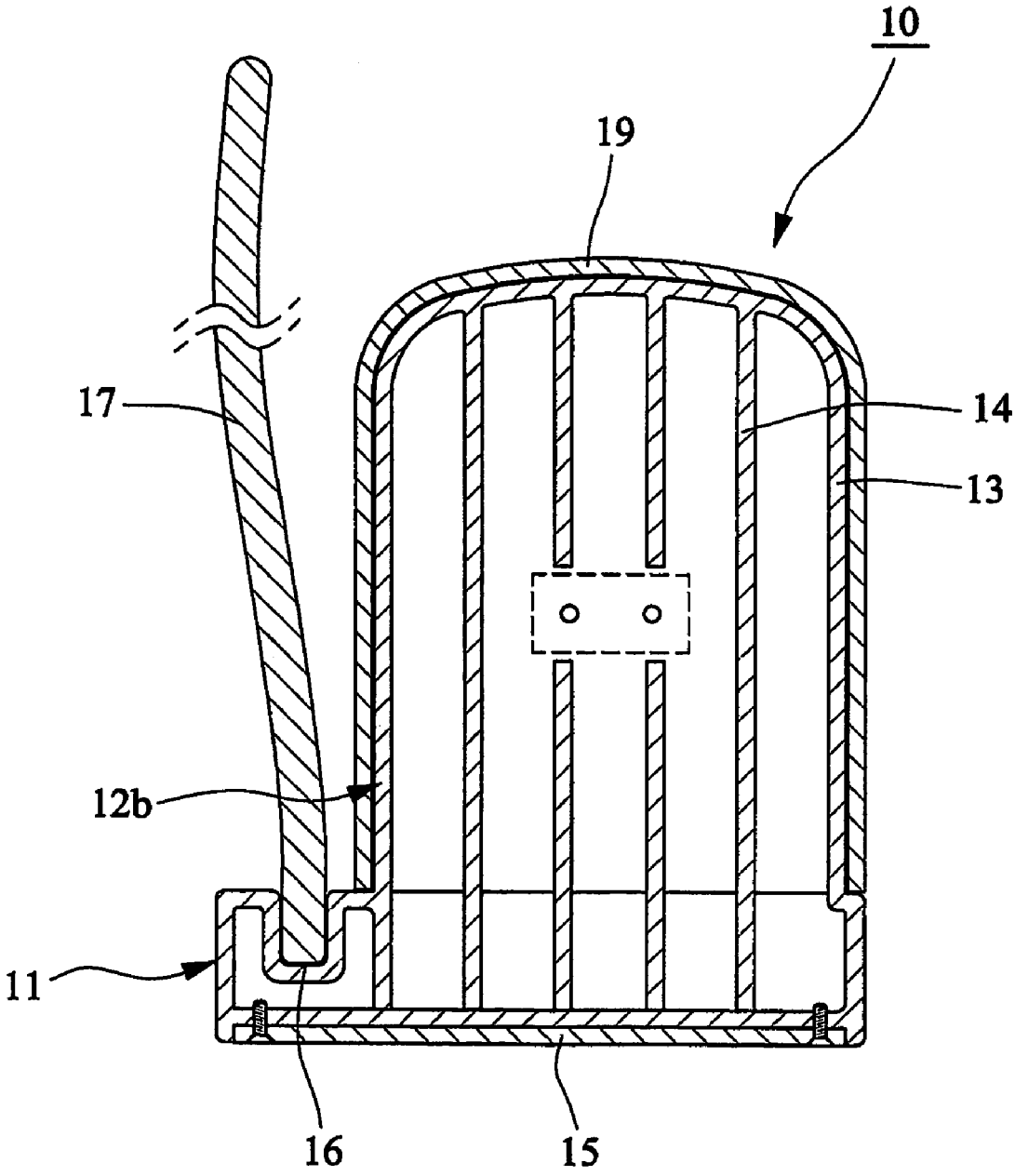
FIG. 2 is a sectional view showing the inner construction of a seat cushion according to the present invention.
Figure 3:
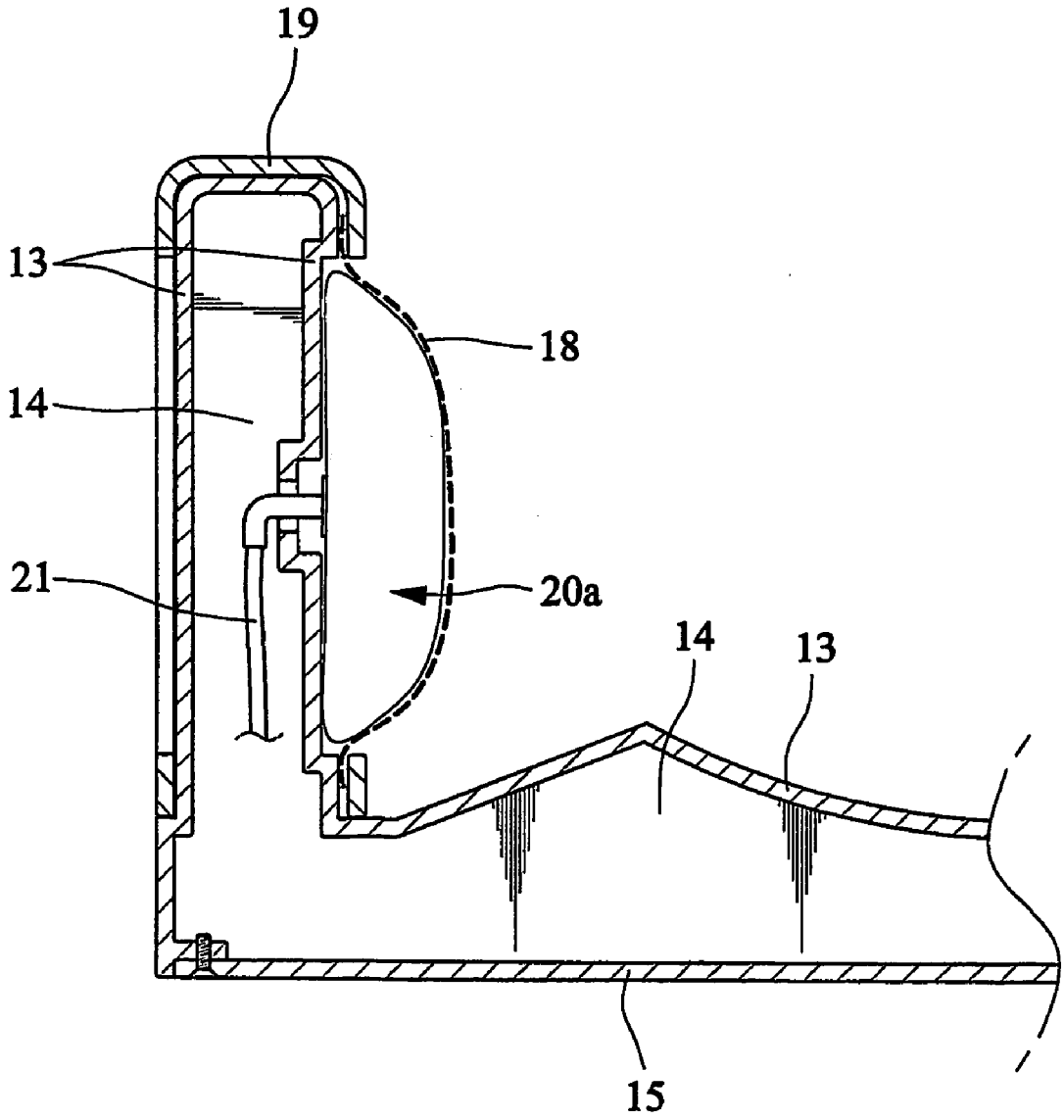
FIG. 3 is a sectional view showing an installation of an air bag.

The seat cushion 11 and the right/left seat sides 12*a*, 12*b*, as shown in FIGS. 2 and 3, are configured as a hollow by plural partitions 14 which are erected in a constant space, and the bottom of the seat cushion 11 is covered by a bottom plate which is demountably screwed to the cushion.

In the inner space of the seat 10, components of an air injection means, a photo detective sensor 39, a far-infrared generator "T", and an oscillating motor "M" which are described hereafter are accommodated.

Figure 4:
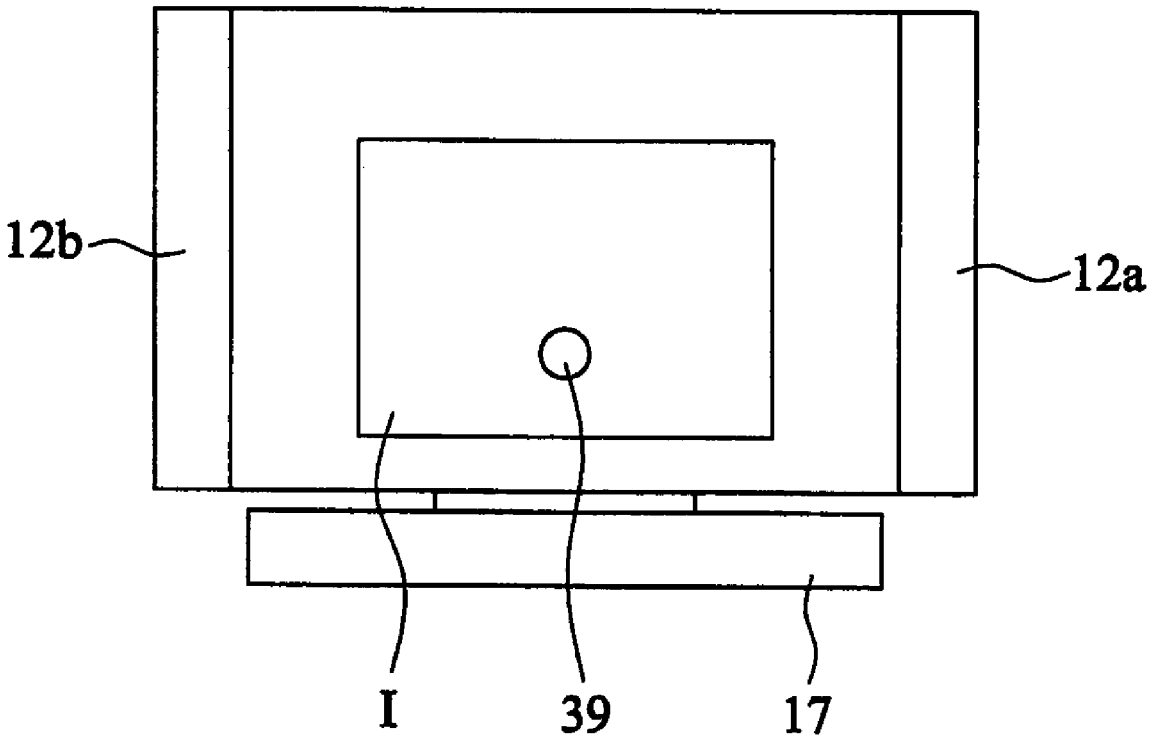
FIG. 4 is a top plan view illustrating an installation of a photo detective sensor and far-infrared generator on a seat cushion.
Figure 5:
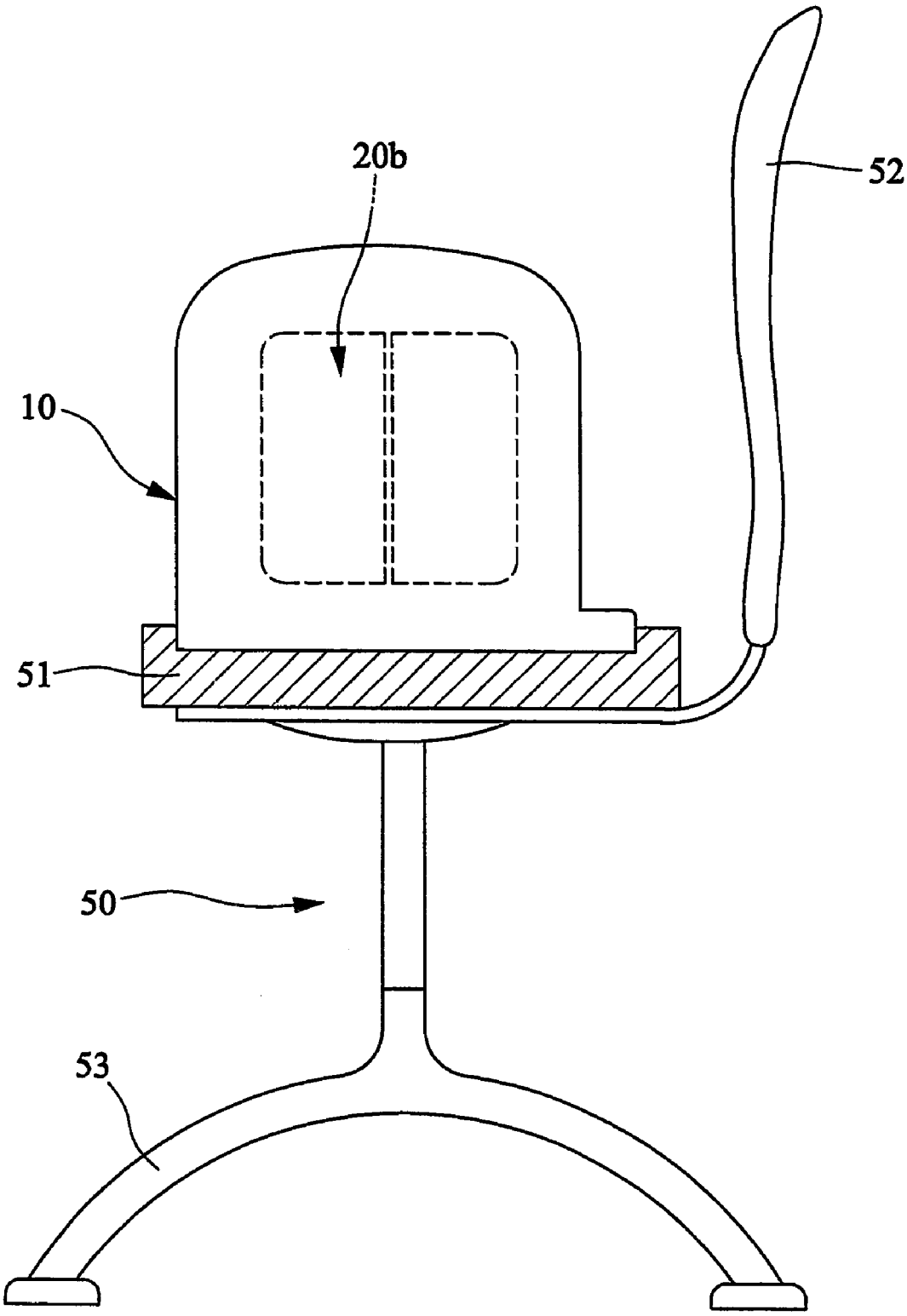
FIG. 5 is a side view of a chair on which the seat is placed.

The photo detective sensor 39, as illustrated in FIG. 4, is exposed at the top of the seat cushion 11, and is detected the light when no occupant is seated. Thus, the operation of the inventive remedial device should be stopped by the command of a controller 35 explained next, thereby eliminating an unnecessary working.

The far-infrared generator "T", as shown in FIG. 4, is installed at an inner portion of the seat cushion 11, which contacts with an occupant's hip. The far-infrared is applied to a pelvis of an occupant, thereby obtaining an effect of fomentation to the pelvis. It will prevent various diseases caused by a cold pelvis.

The oscillating motor "M" and the far-infrared generator "T", as shown in FIG. 1B, are mounted on the seat cushion 11 so as to stimulate an occupant's hip and get a maximum effect of the contraction of a pelvis. The oscillating motor "M" and the far-infrared generator "T", generate the delicate, refined rhythm to enable the movement of a body's nervous system and the blood flow to become more smooth, thereby leading to the acceleration of metabolism. That is, these electronic devices provide the physical stimulation to maintain a control of body's function and a balance of biologic tissue.

In FIG. 1B, an outlet is provided at a bottom of a front edge of the right seat side 12*a*, while the display panel 36 and the control panel 37 are provided at a top of a front edge of the right seat side 12*a* The outlet might be installed at another place, and the panels 36, 37 can be installed at a wire controller 42 or wireless remote controller (not shown) as shown FIG. 1A. That is, the wire controller 42 can be connected to the right seat side 12*a* so that an occupant can easily manipulate key pads of the control panel, otherwise, a signal input window 43 can be installed at the right seat side 12*a* so that an occupant can use a wireless remote controller.

A first seat back 17 is demountably provided at the rear of the right/left seat side 12*a*, 12*b* (FIG. 1A). When a seating position of an occupant, the first seat back 17 is attached to support the back of an occupant, while when a lying down position of an occupant, the first seat back 17 can be separated from the seat 10. As shown in FIG. 1A, the first seat back 17 can be mounted at the rear of the right/left seat sides 12*a*, 12*b*, otherwise, as shown FIG. 2, the first seat back 17 can be inserted into a slot 16 formed at the rear rim of the seat cushion 11.

In the seat cushion 11, a concaved groove (FIG. 1A) is shaped, and when the air bags 20*a*, 20*b* press an occupant's pelvis, the hip of an occupant can be moved toward inside of the seat cushion and it contributes a maximum contraction of a pelvis.

At the central portion of the right/left seat sides 12*a*, 12*b*, as shown in FIGS. 1B to 3, provides a through-hole with which an air nozzle pipe 21 placed in the right/left seat sides 12*a*, 12*b* connects the air bags 20*a*, 20*b* with the right/left air pumps 31*a*, 31*b*. One free end of the air nozzle pipe 21 is secured in a square opening formed around the though-hole.

A flexible fabric 18 is installed round the edge of the right/left seat sides 12*a*, 12*b* to place the air bags 20*a*, 20*b* in their position. The flexible fabric 18 is expanded or contracted owing to the operation of the air bags 20*a*, 20*b* nested between the flexible fabric 18 and the inner side of the right/left seat sides 12*a*, 12*b*. Along the exterior of the right/left seat sides 12*a*, 12*b*, a rim cover 19 is provided to shield a fringe of the flexible fabric 18.

A pair of air bags 20*a*, 20*b* installed in the right/left seat sides 12*a*, 12*b* receive the air from the air injection means to be expanded, or release the air from the air bags to be contracted, thus give a pressure to a pelvis. High strength vinyl bag can be employed as the air bag. A portion of the seat sides corresponding to an occupant's pelvis is independently divided into a front/rear cells 22*a*, 22*b*, 23*a*, 23*b*.

In this invention, a plural of rubber pads 40 are further provided at the exterior of the right/left air bags 20*a*, 20*b*. The rubber pads 40 will be used to properly adjust the pressure against the femoral region depending on an occupant's contour. For instance, a woman who has a smaller pelvis than normal size can employ plural rubber pads to increase the pressure to her femoral region.

Figure 6:
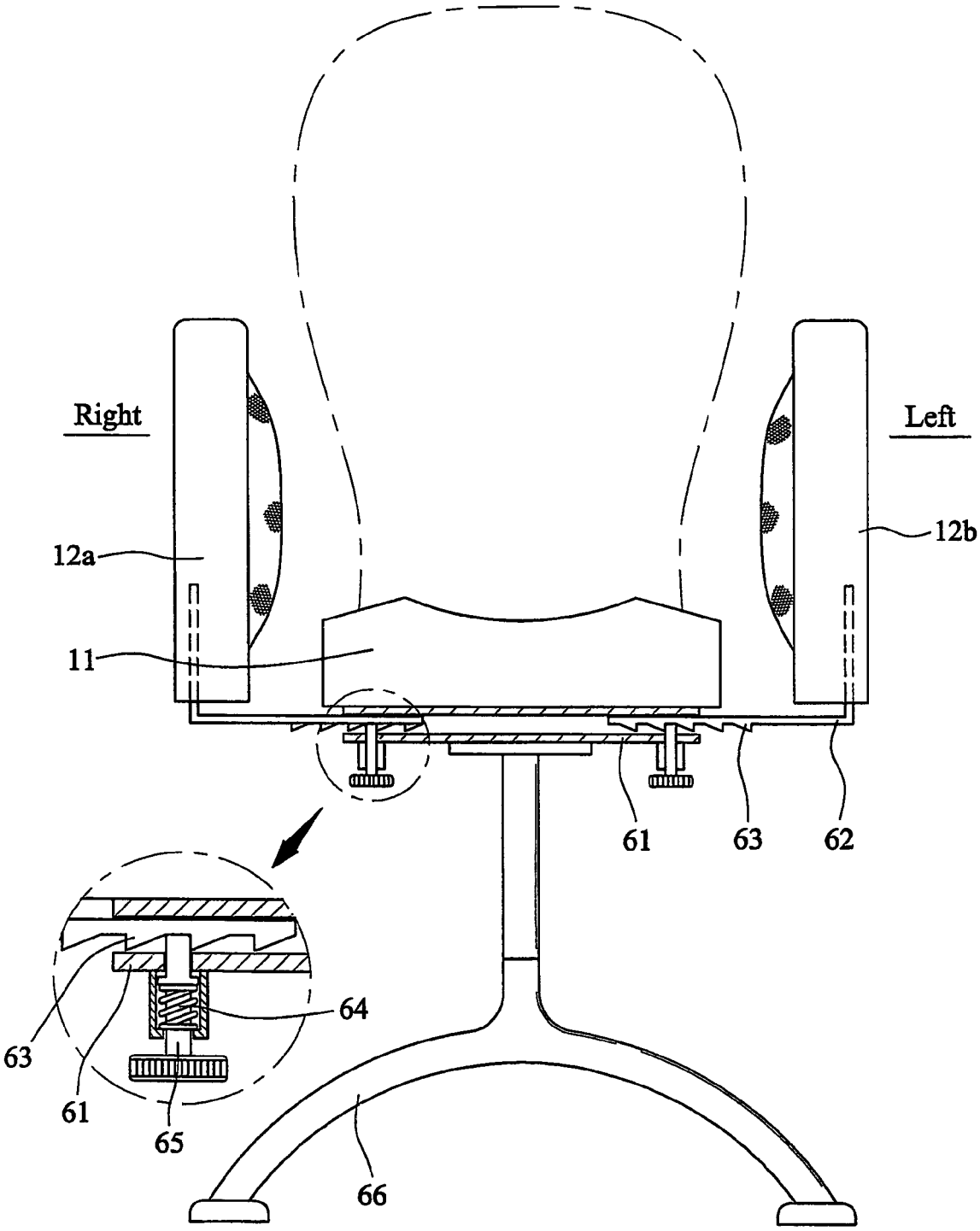
FIG. 6 is a front view of a chair by which the width between the right/left seat side can be adjusted according to an occupant's physical size.

Further, this invention provides a chair 50 on which the seat 10 is placed that can be used as a usual chair. The chair 50, as shown in 5, is comprised of a support plate 51 on which the rim of the seat cushion 11 is tightly nested, a second seat back 52 provided uprightly at the rear portion of the support plate 51 and legs 53 extended down from the support plate 51. The chair can be adapted as shown in FIG. 6, by which the width between the right/left seat sides 12*a*, 12*b* can be adjusted according to an occupant's physical size.

In this embodiment, the seat cushion 11 and the right/left seat sides 12*a*, 12*b* are detached from each other, and a rail 61 is transversely installed at the central bottom of the seat cushion 11. At each end of the rail 61 is provided in a transversal movement a pair of angular connector 62 which is fixed to the right/left seat sides 12*a*, 12*b*. Legs 66 are installed at the central bottom of the rail 61. Plural jaws 63 are formed at the bottom of the angular connector 62 in an even interval. Further, at longitudinal slot (not shown) are installed a pair of stoppers which can be pressed by a spring 64. Therefore, the width between the right/left seat side 12*a*, 12*b* can be adjusted to fit an occupant's physical size, and the stopper 65 restricts the jaws 63 so as not to move the right/left seat sides 12*a*, 12*b*.

Figure 7:
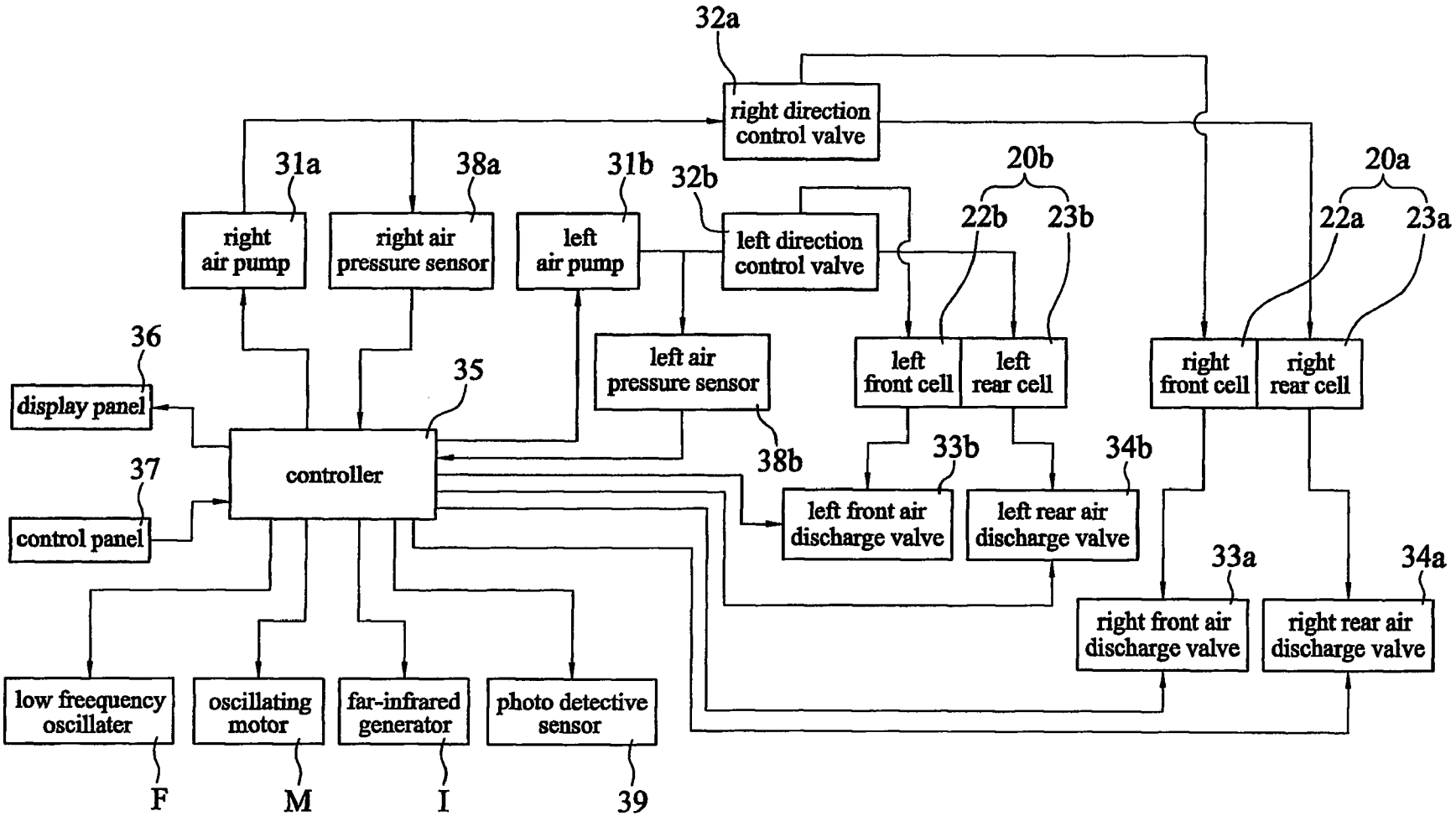
FIG. 7 is a block-diagram illustrating an air injection and its accompanying device according to the present invention.

FIG. 7 is a block diagram illustrating an air injection means and accompanying apparatus according to the invention. The air injection means is comprised of right/left air pumps 31*a*, 31*b* each connected to the right/left air bags 20*a*, 20*b* for supplying the air into the front/rear cells 22*a*, 22*b*, 23*a*, 23*b*, and right/left direction control valves 32*a*, 32*b* for supplying air to all air bags 20*a*, 20*b* or a selective one. Further, the air injection means is comprised of right/left air pressure sensors 38*a*, 38*b* for detecting the pressure of the air fed into the right/left direction control valves 32*a*, 32*b* from the right/left air pumps 31*a*, 31*b*, and right/left front/rear air discharge valves 33*a*, 33*b*, 34*a*, 34*b* for discharging the air from the front/rear cells 22*a*, 22*b*, 23*a*, 23*b*. Furthermore, the air injection means is comprised of a controller 35 for controlling the air pumps 31*a*, 31*b*, direction control valves 32*a*, 32*b* and air discharge valves 33*a*, 33*b*, 34*a*, 34*b*, a display panel 36 for displaying a signal generated from the controller 35, and a control panel 37 having a plurality of operating keys for inputting the signal generated by a pushed key into the controller 35.

With this contribution, the air supplied from the right/left air pumps 31*a*, 31*b* is injected into the right/left directional valves 32*a*, 32*b*. Since left air pressure sensor 38*b* is installed between the left air pump 31*b* and the left directional valve 32*b*, the air pressure supplied into the left control valve 32*b* from the left air pump 31*b* can be detected and the signal value of the detected air pressure is sent to the controller 35. Similarly, since the right air pressure sensor 38*a* is installed between the right air pump 31*a* and the right directional valve 32*a*, the air pressure supplied into the right control valve 32*a* from the right air pump 31*a* can be detected and the signal value of the detected air pressure is sent to the controller 35.

The controller 35' receives the signal of air pressure detected by the air pressure sensors 38*a*, 38*b* and compares it with a pressure level which is inputted through the control panel by an occupant. After a comparison, if the detected pressure value is larger than a predetermined set value, the operation of the air pumps 31*a*, 31*b* is stopped and no more air is injected into the air bags 20*a*, 20*b*.

Under a command of the controller 35, the right/left direction control valves 32*a*, 32*b* supplies or relieves the air into/from the front/rear cell 22*b*, 23*b* of the left air bag 20*b* and the front/rear cells 22*a*, 23*a* of the right air bag 20*a*.

When the left direction control valve 32*b* supplies the air into the front cell 22*b* of the left air bag 20*b*, the front cell of the left air bag 20*b* is expanded to apply a press to the left front portion of a pelvis. Similarly, when the left direction control valve 32*b* supplies the air into the rear cell 23*b* of the left air bag 20*b*, the rear cell of the left air bag 20*b* is expanded to apply a press to the left rear portion of a pelvis.

The operation of the left side as explained above will be adapted to the right direction control valve 32*a* and the right air bag 20*a* of the right side. Therefore, with the control of the left direction control valve 32*b*, the air can supply either front cell 22*b* or rear cell 23*b* of the left air bag 20*b* selectively; in the same manner, with the control of the right direction control valve 32*a*, the air can supply either front cell 22*a* or rear cell 23*a* of the right air bag 20*a* selectively.

Figure 8A:
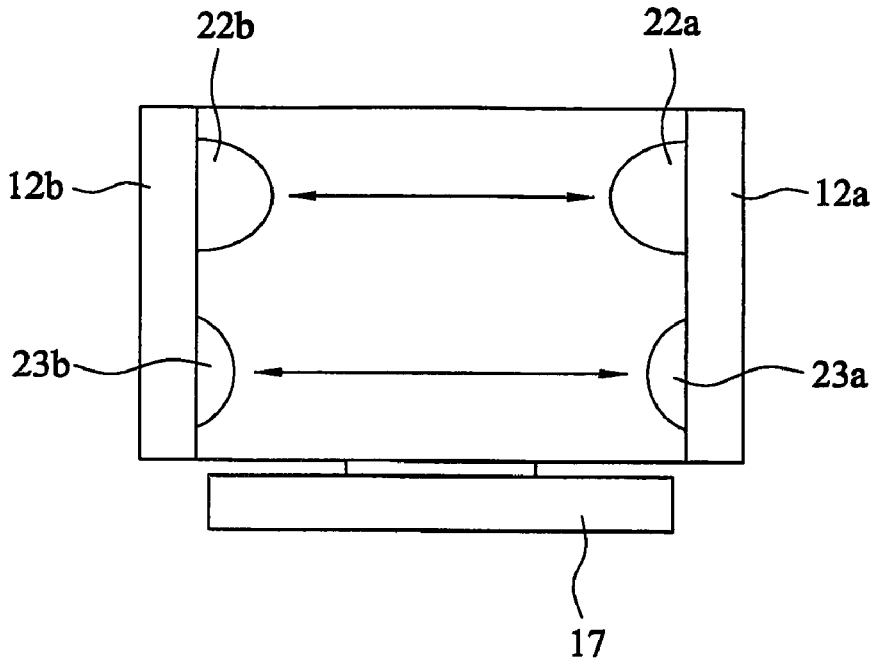
FIG. 8A, 8B are top plan views illustrating state of air-injecting to either a front cell or rear cell of a right/left air bag.
Figure 8B:
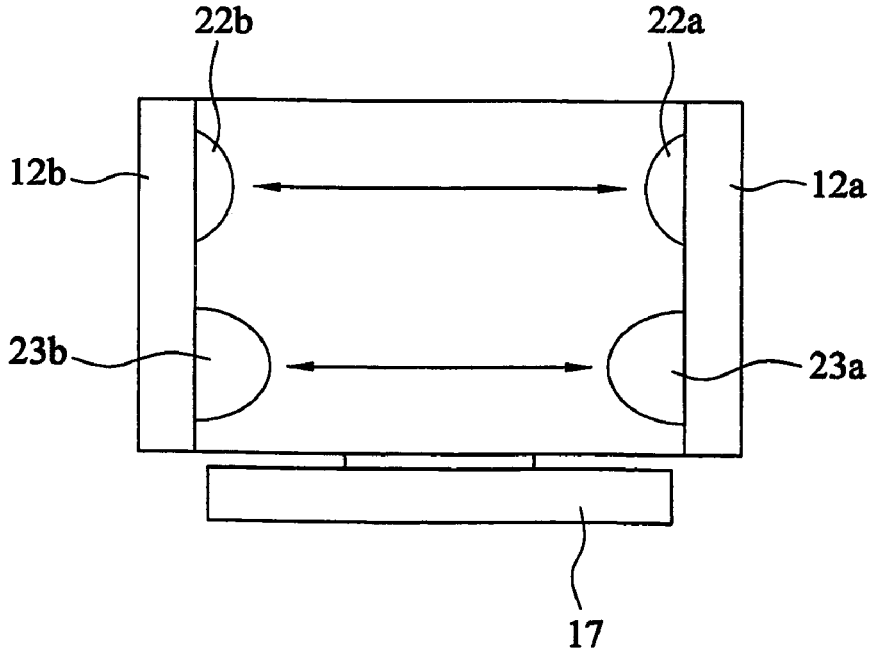

To enable the remedial device to be operated as massage function, as shown in FIGS. 8A and 8B, the air can be supplied either both of front cells 22*a*, 22*b* or both of rear cells 23*a*, 23*b* of the right/left air bags 20*a*, 20*b* simultaneously or the supply of the air can be interrupted. When the air is supplied into the front cells 22*a*, 22*b* of the right/left air bags 20*a*, 20*b* simultaneously, a front portion of pelvis is pressed, whitest when the air is supplied into the rear cells 23*a*, 23*b* of the right/left air bags 20*a*, 20*b* simultaneously, a rear portion of pelvis is pressed. As the air is supplied or relieved into/from the front/rear cells 22*a*, 22*b*, 23*a*, 23*b* alternately for a predetermined time period, the effect of pelvis massage and pelvis remedy can be achieved.

The level of air pressure supplied into the right/left air bags 20*a*, 20*b* categorizes into three such as "high", "medium" and "low" by the control of level key pads provided on the control panel 37. For instance, "high" can be set to 290±10 mmHg, "medium" can be set to 230±10 mmHg and "low" can be set to 140±10 mmHg. Even when the air discharge from the air bags 20*a*, 20*b*, the value of pressure dose not need to be set to "0", and "high" may be set to 180±10 mmHg, "medium" may be set to 150±10 mmHg and "low" may be set to 90±10 mmHg. Therefore, the value of pressure can be maintained to support a pelvis of an occupant even when the air is discharged from the air bags 20*a*, 20*b*.

In the inventive remedial device, as the operation of the right/left direction valves 32*a*, 32*b* and the front/rear discharge valves 33*a*, 33*b*, 34*a*, 34*b* can be made a combination and many modes, such as front press, rear press, front/rear simultaneous press, front/rear crossing press, and expansion/contraction repeating A pelvis remedial seating device is provided having a seat including a seat cushion on which an occupant is to be seated and left/right seat sides provided uprightly at each side end of the seat cushion; a pair of air bags nested to a height of the pelvis portion of an occupant on an inner side of each side for enabling themselves to be expanded or contracted by air supplied into or discharged from the inside of the air bag; air injector for providing air pressure to the air bags; and a controller for controlling running time, level, and direction of air flow supplied through the air injection means, wherein the expanding air pressure in the air bags presses the pelvis portion of an occupant. press, etc. can be performed.

The far-infrared generator "T", the low frequency oscillator "T" and an oscillating motor "M" are installed at the bottom of the seat cushion 11 as explained above. The operation of these devices can combine with the working of the air bags 20*a*, 20*b* to achieve pelvis remedy in various modes. For example, the 'fumble with pressing' effect can be attained at the low frequency oscillator "F" with 'fumble with pressing' mode, and at the same time, all portion of pelvis can be massaged by the repeated press and release using the front/rear cells 22*a*, 22*b*, 23*a*, 23*b*.

Figure 9:
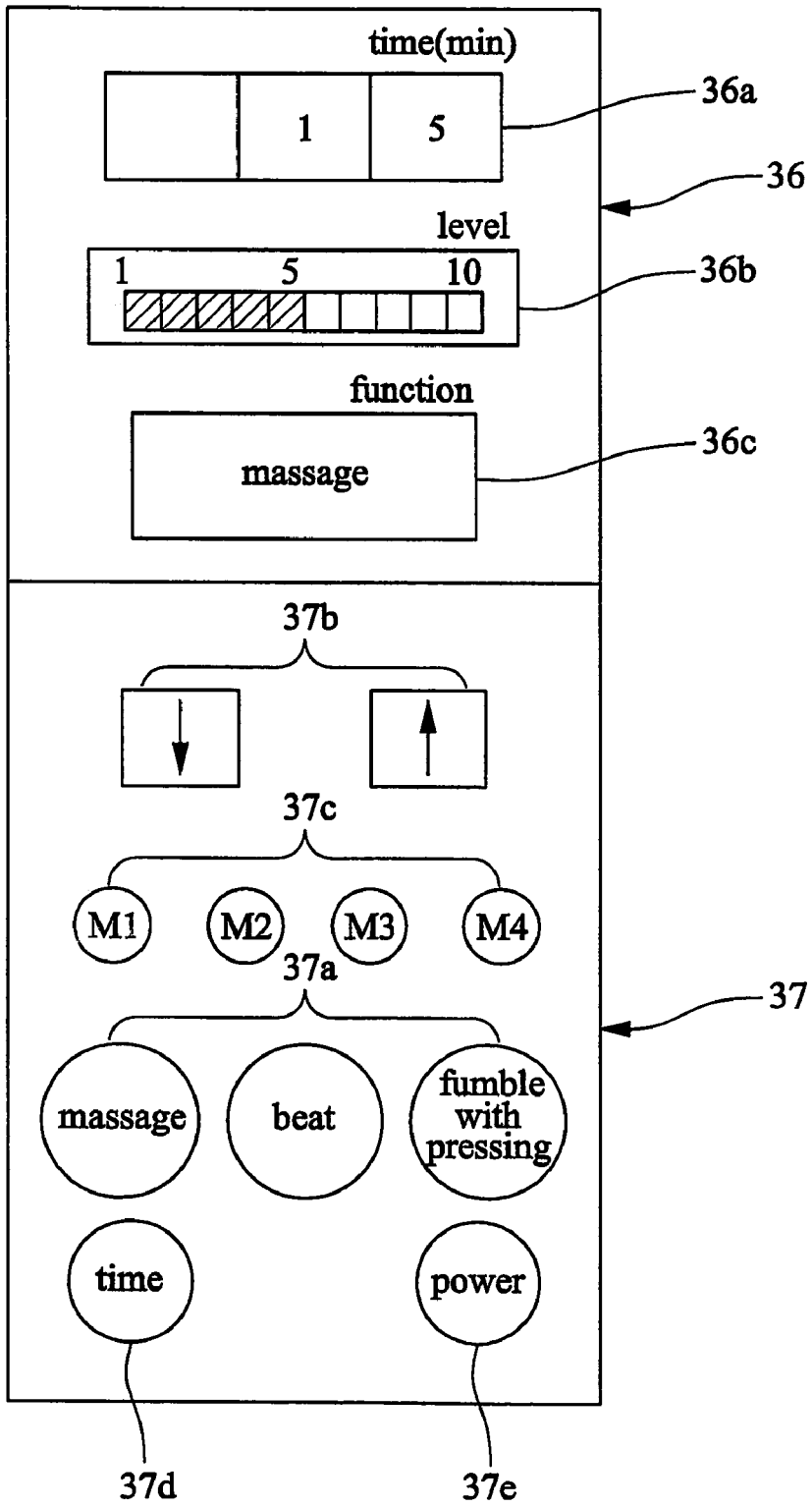
FIG. 9 is a view showing one embodiment of a display panel and a control panel employed at an air injection means.

FIG. 9 illustrates one embodiment of the display panel 36 and the control panel 37 employed at the pelvis remedial device. The display panel 36 performs a function for displaying a signal generated from the controller 35, and the control panel 37 has a plurality of operating keys for inputting the corresponding signal generated by a pushed key into the controller 35.

The display panel 36 is comprised of a timer unit 36*a* indicating the running duration of the remedial device, a level indicating unit 36*b* for displaying the level of a chosen function and a function indicating unit 36*c* for displaying which function an occupant choose.

The control panel 37 is comprised of plural function key pads 37*a* for selecting an adaptable function such as "massage", "beat", and "fumble with pressing", a pair of level key pads 37*b* for setting the level of a function chosen, plural mode key pads 37*c* for choosing various mode, a time set key pad 37*d* for setting a running duration of the chosen function or the mode and a power key pad 37*e* for turning on/off power.

An occupant pushes the power key pad to apply the power to the device, and a default set time is displayed on the timer unit 36*a*, and also a value of a level chosen previously is shown on the level indicating unit 36*b*. When an occupant presses the "massage" key among the function key pads 37*a*, a signal corresponding to "massage" function is sent to the controller 35 from the control panel 37.

Under a command of the controller 35, a character "massage" is shown on the function indicating unit 36*c*, and a default time is displayed on the timer unit 36*a*, and the level of the chosen function is presented on the level indicating unit 36*b*. With a command of the controller 35, the right/left air pumps 31*a*, 31*b* supply the air into the front/rear cells 22*a*, 22*b*, 23*a*, 23*b* of the right/left air bags 20*a*, 20*b*. The air pressure supplied to the cells can be adjusted by the level key pads 37*b*.

The air pressure supplied to the cells 22*a*, 22*b*, 23*a*, 23*b* of the air bags 20*a*, 20*b* is established as 10 levels between 50~500 mmHg, and each level value has 50 mmHg. That is, first level corresponds to 50 mmHg, and second level corresponds to 100 mmHg, third level corresponds to 150 mmHg, . . . , and tenth level corresponds to 500 mmHg.

An occupant can select one function, such as "massage", or "beat", or "fumble with pressing" among the function key pads 37*a*. During running of the device, however, if a weakening air pressure is felt, an occupant presses a "↑" key pad of, indicating an ascend of an air pressure, the level key pads 37*b*, and an air pressure having one level higher than a present pressure value is supplied to the cells of the air bags 20*a*, 20*b*. While still pressing the "↑" key pad, the level increases up to the tenth level, in which the time between each one level increase can be set at 5 seconds.

A state of air pressure value is displayed on the level indicating unit 36*b*. In this embodiment, if the chosen value of air pressure is 150 mmHg, three bars are shown on the level indicating unit 36*b*. When pressing the "↑" key pad to increase one level, the four bars are shown on the level indicating unit 36*b*. Similarly, a descent "↓" key pad is pressed one time and one level is decreased. While still pressing the "↓" key pad, each bar is eliminated per 5 seconds, finally one level is arrived.

After an occupant selects the function by pressing on one key among the function key pads 37*a*, a running duration is selected by pressing the time set key pad 37*d*. When choosing the function for the first time, for example, "0" is displayed on the timer unit 36*a*. A value corresponding to 1 minute is shown on the timer unit 36*a* as the timer set key pad 37*d* is pressed one time. One minute is added to the existed value in proportion to press count of the time set key pad 37*d*. While still pressing the time set key pad 37*d*, the displaying value increases up in a predetermined speed (e.g. 1 minute per 1 second).

Further, with the mode key pads 37*c*, four modes can be chosen, in which a combination of "massage", "beat", "fumble with pressing" can be accomplished in constant pattern. If "M1" is a mode repeating "massage", "beat", "fumble with pressing", when an occupant presses "M1", the front/rear cells 22*a*, 22*b*, 23*a*, 23*b* are expanded or contracted repeatedly in a constant pattern, thus achieving a repeating function of "massage", "beat", "fumble with pressing".

Figure 10:
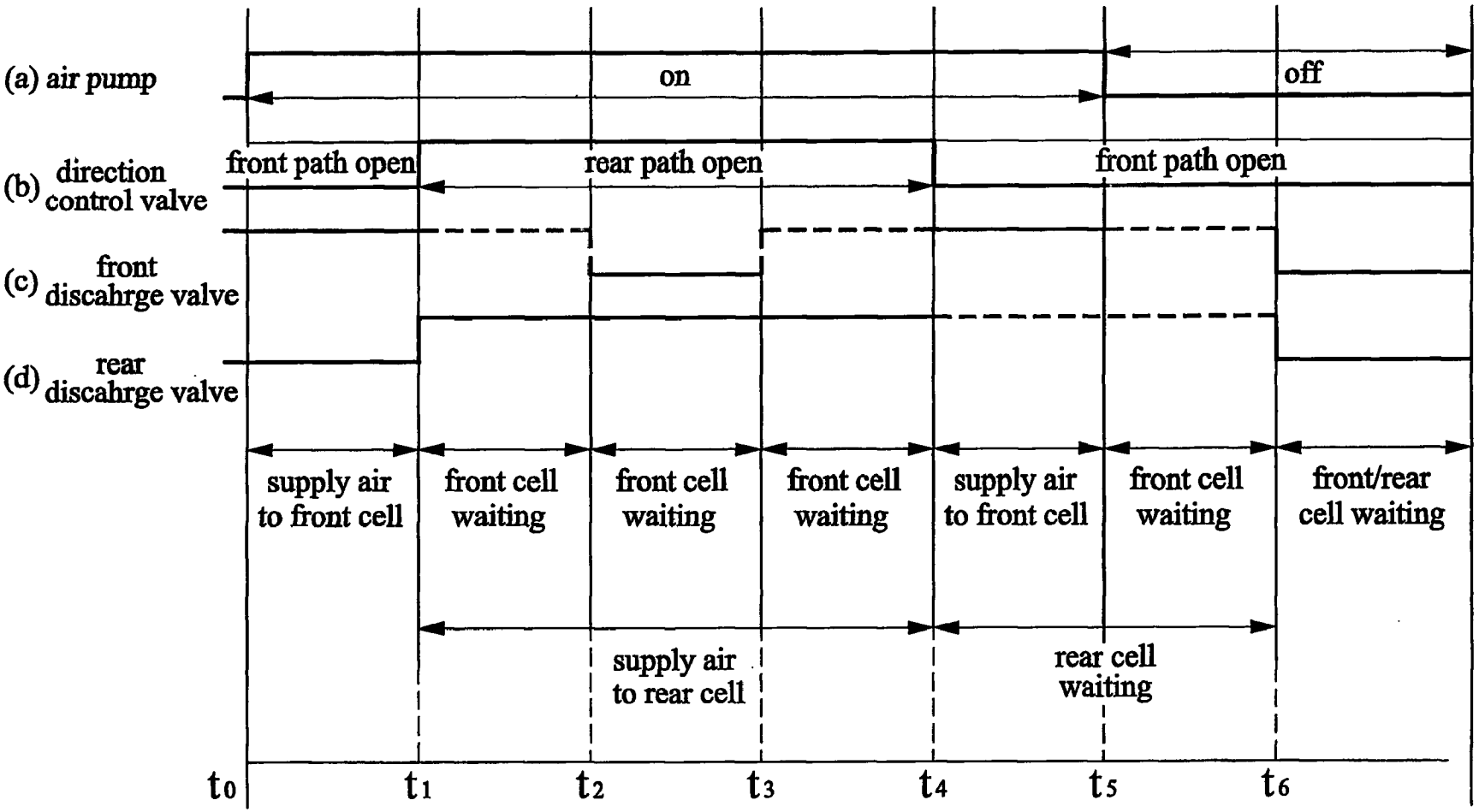
FIG. 10 is a timing chart illustrating that the inventive remedial device controls operation of the right/left direction control value and the front/rear air discharge value.

FIG. 10 is a timing chart illustrating that the inventive remedial device controls operation of the right/left direction control value and the front/rear air discharge value. At time $t_0$, power is applied to the right/left air pumps 31*a*, 31*b*, and the air is supplied to the front/rear cells 22*a*, 22*b*, 23*a*, 23*b* from the air pumps 31*a*, 31*b*. After that, the front path of the right/left direction control valves 32*a*, 32*b* is opened for the air to feed into the front cells 22*a*, 22*b*. Since the right/left front air discharge valves 33*a*, 33*b* is closed and the right/left rear air discharge valves 34*a*, 34*b* is opened, the front cells 22*a*, 22*b* is expanded, thus pressing the front portion of the pelvis.

At time $t_1$, under a command of the controller 35, since the right/left direction valves 32*a*, 32*b* opens its rear path, and closes its front path, the air is supplied to the rear cells 23*a*, 23*b*. Since the right/left front air discharge valves 33*a*, 33*b* maintain its closed state, and the right/left rear air discharge valves 34*a*, 34*b* are closed, the front/rear cells 22*a*, 22*b*, 23*a*, 23*b* are expanded, thus pressing the front/rear portion of the pelvis.

At time $t_2$, in the right/left directional valves 32*a*, 32*b*, its rear path is still opened, and its front path is continually closed, and thus the air is still supplied to the rear cells 23*a*, 23*b*. Since the front air discharge valves 33*a*, 33*b* are opened, the air is discharged from the right/front cell 22*a*. With the state of the pressure release against the front portion of a pelvis, the rear air discharge valves 34*a*, 34*b* are still closed and the rear cells 23*a*, 23*b* maintain its expansion state, thus pressing the rear portion of the pelvis.

At time $t_3$, the right/left directional valves 32*a*, 32*b* supply the air to the rear cells 23*a*, 23*b* still, and since the front air discharge valves 33*a*, 33*b* are being opened, but the front path is still closed, the air is not supplied to the front cells 22*a*, 22*b*, thus no pressing is applied to the front portion of the pelvis. Since the rear air discharge valve is still closed, the rear cells 23*a*, 23*b* maintain its expansion state, thus continuing the pressing to the rear portion of the pelvis.

At time $t_4$, under a command of the controller 35, since the right/left directional valves 32*a*, 32*b* open its front path to supply the air to the front cells 22*a*, 22*b*, and close its rear path, the air is not supplied to the rear cells 23*a*, 23*b*. Since the front air discharge valves 33*a*, 33*b* as well as the rear air discharge valves 34*a*, 34*b* maintain their closed state, the front cells 22*a*, 22*b* stay in the air supply state, and the rear cells 23*a*, 23*b* are expanded, thus pressing the front/rear portion of the pelvis.

At time $t_5$, under a command of the controller 35, the right/left directional valves 32*a*, 32*b* still open its front path, but no power is applied to the air pumps 31*a*, 31*b*, and the air is not supplied to the front cells 22*a*, 22*b*. Also, since the rear path is closed, no air is supplied to the rear cells 23*a*, 23*b*. At this time, the front/rear air discharge valves are still closed, and the front/rear cells 22*a*, 22*b*, 23*a*, 23*b* maintain their expansion state, thus pressing continuously the front/rear portion of the pelvis.

At time $t_6$, the air pumps 31*a*, 31*b* and the right/left directional valves 32*a*, 32*b* maintain their previous state, but the front/rear air discharge valves 33*a*, 33*b*, 34*a*, 34*b* are opened, and the air is discharged from each front/rear cell 22*a*, 22*b*, 23*a*, 23*b*, thus releasing the pressing against the pelvis.

Figure 11:
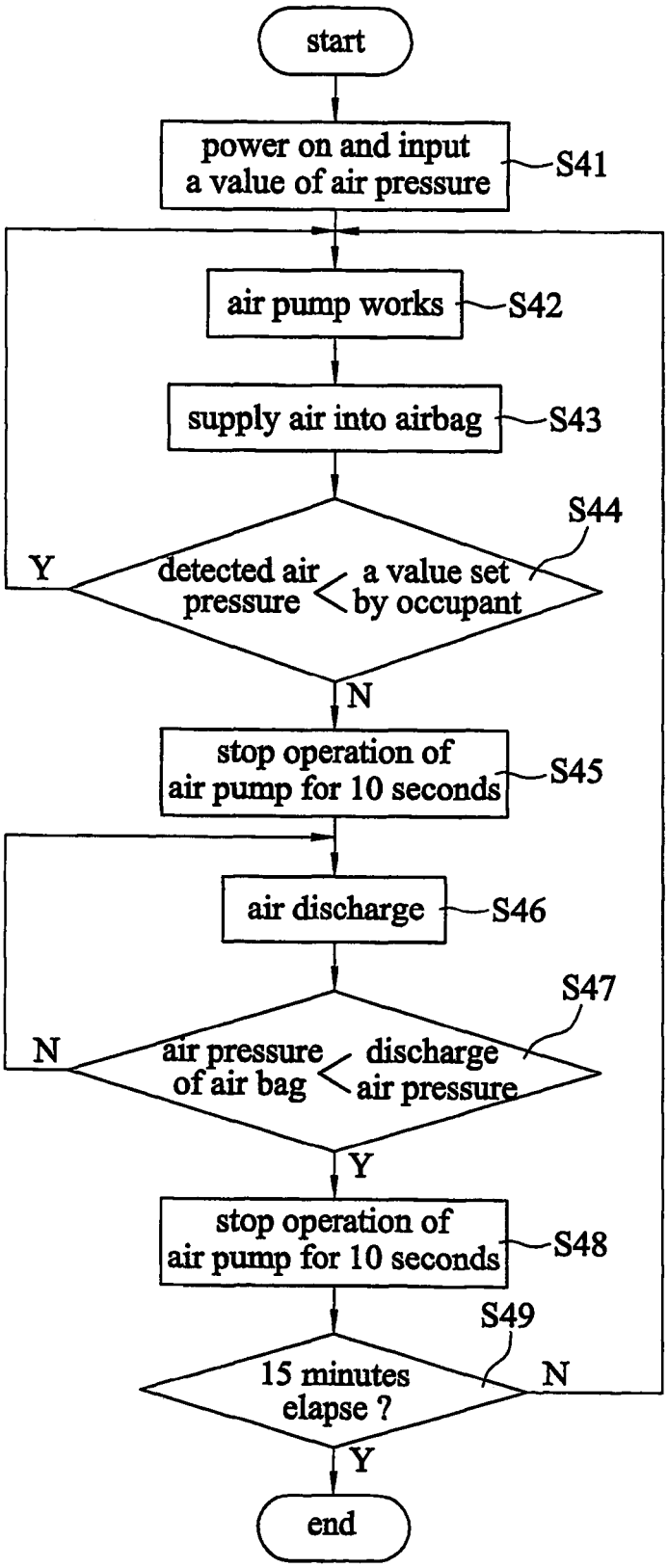
FIG. 11 is a flow chart illustrating a control method in which the remedial device is operated as a "massage" function.

FIG. 11 is a flow chart illustrating a control method in which the remedial device is operated as a "massage" function. After the power is applied, a value of press level chosen by an occcupant is inputted through the control panel (step S41), the right/left air pumps 31*a*, 31*b* are operated and the air is supplied into the right/left air bags 20*a*, 20*b* (step S42), the right/left directional valves 32*a*, 32*b* are controlled and the air is supplied into each front/rear cell 22*a*, 22*b*, 23*a*, 23*b* (step S43).

The air pressure of the air bags 20*a*, 20*b* is detected by the air pressure sensors 38*a*, 38*b*, and the controller determines whether the detected air pressure is lower than a value set by an occupant, and if it is, returns to step S42. If it is not, goes to next step S45 (step S44). At step S45, a running of the air pumps 31*a*, 31*b* is stopped for predetermined period (e.g. 10 seconds) and the air pressure of the air bags 20*a*, 20*b* can be maintained as the setting value. At step S46, the front/rear air discharge valves 33*a*, 33*b*, 34*a*, 34*b* are opened and the air is discharged until the air pressure of the air bags 20*a*, 20*b* is lower than a discharge pressure.

At step S47, the controller determines whether the air pressure of the air bags 20*a*, 20*b* is lower than a discharge pressure, if it is not, returns to step S46. If it is, goes to next step S48. At step S48, the running of the air pumps 31*a*, 31*b* is stopped for predetermined period (e.g. 10 seconds). At step S49, the controller compares the present time elapsed from step S41 with the predetermined set time (e.g. 15 minutes). If the present time has not, returns to step S42. If it has, goes to stop step where the execution of e program is terminated.

As above, the injection and discharge operation into/from the front/rear cells 22*a*, 22*b*, 23*a*, 23*b* is repeated, thus attaining the effect of pelvis's massage.

Figure 12A:
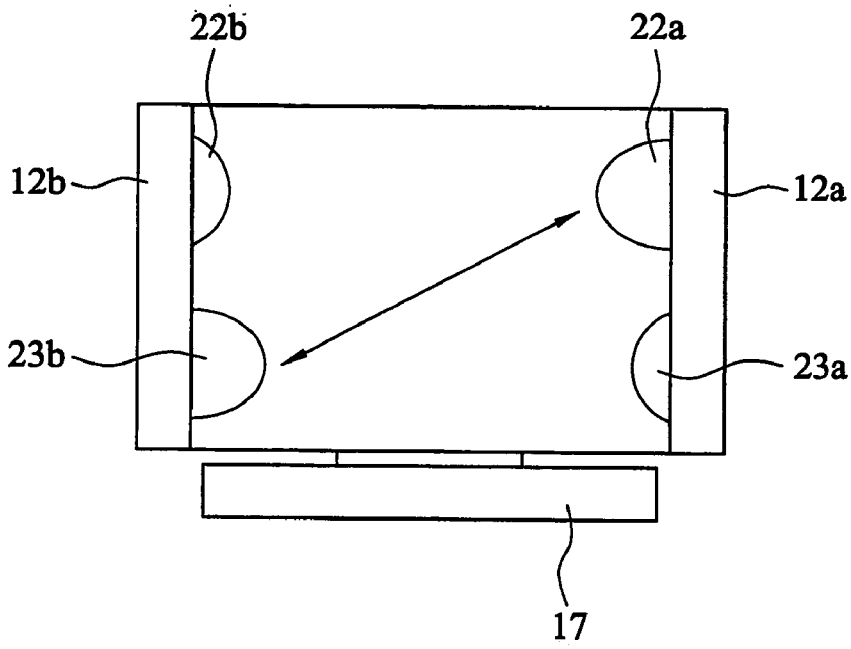
FIG. 12A, 12B are top plan views illustrating air injection and discharge into/from front/rear cell diagonally.
Figure 12B:
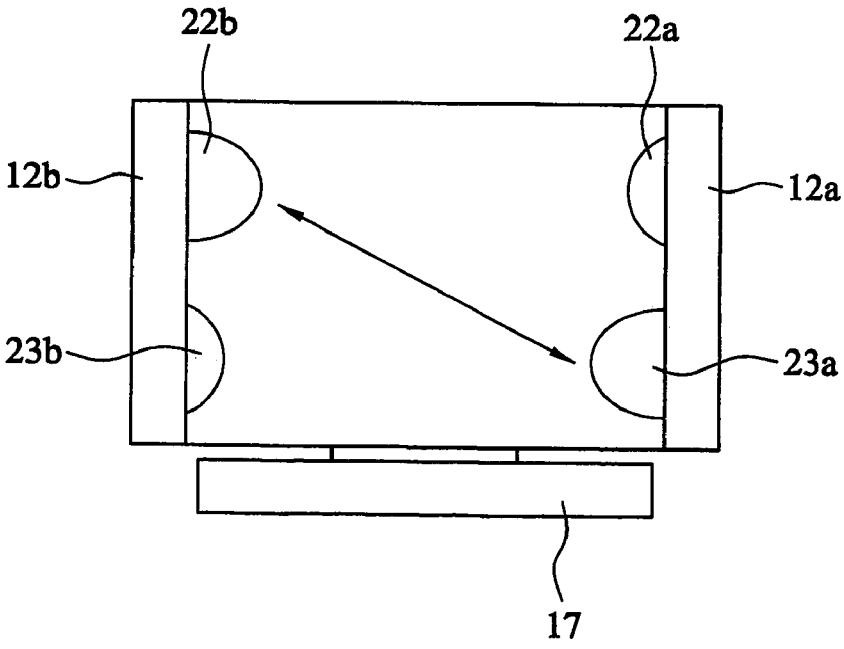

When a pelvis is crooked, to remedy the crooked pelvis, a left/front portion and a right/rear portion of a pelvis are pressed, otherwise a right/rear portion and a left/front portion of a pelvis are pressed in opposite to the crooked direction. For example, when right portion of a pelvis is crooked backward and left portion of a pelvis is crooked forward, as shown in FIG. 12A, the air is supplied to the front cell 22*b* of the left air bag 20*b* and the rear cell 23*a* of the right air bag 20*a*, and the air is discharged to a predetermined pressure value from the rear cell 23*b* of the left air bag 20*b* and the front cell 22*a* of the right air bag 20*a*. Similarly, when left portion of a pelvis is crooked backward and right portion of a pelvis is crooked forward, as shown in FIG. 12B, the air is discharged to a predetermined pressure value from the front cell 22*b* of the left air bag 20*b* and the rear cell 23*a* of the right air bag 20*a*, and the air is supplied to the rear cell 23*b* of the left air bag 20*b* and the front cell 23*a* of the right air bag 20*a*.

Figure 13:
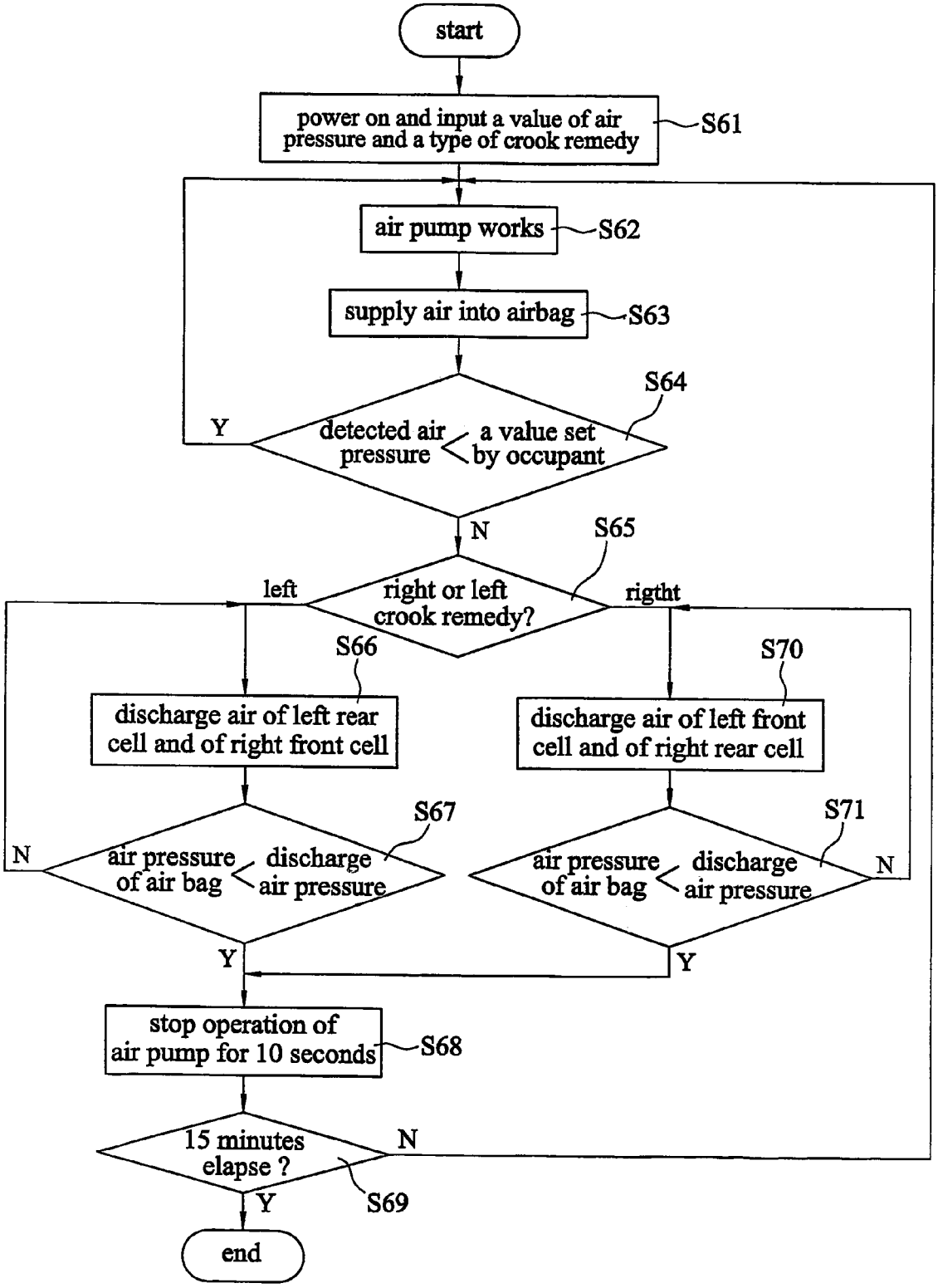
FIG. 13 is a flow chart illustrating a control method of the remedial device to remedy a crooked pelvis.

FIG. 13 is a flow chart illustrating a control method of the remedial device to remedy a crooked pelvis. After the power is applied, the value of press level chosen and a type of crookedness remedy by an occupant is inputted through the control panel (step S61), the right/left air pumps 31*a*, 31*b* are operated and the air is supplied into the right/left air bags 20*a*, 20*b* (step S62), the right/left directional valves 32*a*, 32*b* are controlled and the air is supplied into each front/rear cell 22*a*, 22*b*, 23*a*, 23*b* (step S63).

The air pressure of the air bags 20*a*, 20*b* is detected by the air pressure sensors 38*a*, 38*b*, and the controller determines whether the detected air pressure is lower than a value set by an occupant; if it is, returns to step S62. If it is not, goes to next step S65 (step S64). At step S65, the controller determines whether a type of crookedness remedy is a right crookedness remedy or a left crook remedy. If it is the left remedy, the left/rear air discharge valve 34*b* and the right/front air discharge valve 33*a* are operated, and the air is discharged until the air pressure of the left/rear cell 23*b* and the right/front cell 22*a* is the appropriated one to support an occupant's pelvis (step S66). At step S67, the controller determines whether the air pressure of the left/rear cell 23*b* and the right/front cell 22*a* is lower than a discharge pressure, if it is not, returns to step S66. If it is, goes to next step S68. At step S68, a running of the air pumps 31*a*, 31*b* is stopped for predetermined period (e.g. 10 seconds). At step S69, the controller compares the present time elapsed from step S61 with the predetermined time (e.g. 15 minutes). If the present time has not, returns to step S62. If it has, goes to stop step where the execution of the program is terminated.

Meanwhile, at step S65, if the determination is a left crookedness remedy, the left/front air discharge valve 33*b* and the right/rear air discharge valve 34*a* are operated, and the air is discharged until the air pressure of the left/front cell 22*b* and the right/rear cell 23*a* is the appropriated one to support an occupant's pelvis (step S70). At step S71, the controller determines whether the air pressure of the left/front cell 22*b* and the right/rear cell 23*a* is lower than a discharge pressure, if it is not, returns to step S70. If it is, goes to step S68 and follows the process.

Therefore, the air is supplied to the front cell 22*b* of the left air bag 20*b* and the rear cell 23*a* of the right air bag 20*a*, and the air pressure corresponding to a selected level is applied. At the same time, the air is discharged from the front cell 23*b* of the rear air bag 20*b* and the front cell 22*a* of the right air bag 20*a* Thus, the left pelvis is pressed backward and the right pelvis is pressed forward. As the result, the left forward crooked pelvis is pushed in a right forward direction, thus attaining the straightening effect.

Similarly, the air is supplied to the rear cell 23*b* of the left air bag 20*b* and the front cell 22*a* of the right air bag 20*a*, and the air pressure corresponding to a selected level is applied. At the same time, the air is discharged from the front cell 22*b* of the left air bag 20*b* and the rear cell 23*a* of the right air bag 20*a* Thus, the right pelvis is pressed backward and the left pelvis is pressed forward. As the result, the right forward crooked pelvis is pushed in a left forward direction, thus attaining the straightening effect.

As the present invention is comprised of as above, it is very useful to contract the widened pelvis by pressing a woman's pelvis and curing the crooked pelvis. The widening of a pelvis caused by sexual life and birth can be cured to go back to an original condition such as a woman's pelvis in her twenties.

INDUSTRIAL APPLICABILITY

According to the inventive pelvis remedial seated device and a control method thereof described above, the air pressure can be controlled as one's pleasures with seating or lying down relaxedly and the pelvis portion of a woman can be pressed smoothly in a continuous and repeated manner, which leads to good usability and moderation to the human body. Also, a widened pelvis of woman after the birth is returned to its original place so as to maintain a good shape as soon as it can.

Further, the present invention has an effect in that the pressure can be applied by the expansion and contraction of air bags, and various mode such as massage, beat and fumble with pressing can be selected, thus achieving the pelvis remedy promptly.

Further, the present invention has an effect in that when the detected pressure level of air bags become the predetermined level set by user, the air supply can be stopped, thus pressing the human irrespective of human's contour in a predetermined pressure level.

Further, the present invention has an effect in that a front or a rear cell of air bags provided at each right or left side can be expanded or contracted crosswise, and in the case of a crooked pelvis, the pressure can be applied in the opposite direction against the crookedness direction, thus enabling the crooked pelvis to be cured.

Additionally, the present invention has various practical uses for human's body remedy in that a knee of user can be put on a seat bottom and can be pressed, thus utilizing the remedy of splayed legs in a form of "O".

The prevent invention as above is the useful invention in which the feminine function decreases and the disease caused by the widened pelvis can effectively be cured.

Although preferred embodiments of the present invention have been described for illustrative purposes, those skilled in the art will appreciate that various modifications, additions and substitutions are possible, without departing from the scope and spirit of the invention as defined in the accompanying claims.

The invention claimed is:

1. A pelvis remedial seating device comprising:

a seat including a seat cushion on which an occupant is to be seated and left/right seat sides provided uprightly at left and right sides of the seat cushion; a pair of air bags nested on an inner side of each side for enabling themselves to be expanded or contracted by air supplied into or discharged from the inside of the air bag;

air injection means for providing air pressure to the air bags;

a controller for controlling running time, level, and direction of air flow supplied through the air injection means, wherein the expanding air pressure in the air bags presses the pelvis portion of an occupant; and wherein the seat has a detachably mounted first seat back provided at the rear of the left/right seat sides.

2. The pelvis remedial seating device as set forth in claim 1, wherein the seat has a concaved groove at the center thereof where the hips of an occupant is set.

3. The pelvis remedial seating device as set forth in claim 1, wherein a flexible fabric is installed around an edge of each right/left seat side and each air bag is nested between the flexible fabric and the inner side of each right/left seat side.

4. The pelvis remedial seating device as set forth in claim 1, wherein a plural of rubber pads, of which the number depends on an occupant's contour, are further provided at an exterior of each air bag for increasing the pressure against the femoral region.

5. The pelvis remedial seating device as set forth in claim 1, further comprising a chair on which the seat is placed wherein the chair is comprised of a support plate on which a rim of the seat cushion is fixedly nested, a second seat back provided uprightly at a rear portion of the support plate and legs extended down from the support plate.

6. The pelvis remedial seating device as set forth in claim 1, wherein the seat cushion and the right/left seat sides are detachable from each other, and the seat having a bottom, a centrally located, transversely extending rail is installed on the bottom of the seat cushion so that each seat side is slid along a longitudinal slot of the rail, by which a distance between the right/left seat side can be adjusted according to an occupant's physical size.

7. The pelvis remedial seating device as set forth in claim 6, wherein legs are installed at a central location on a bottom side of the rail.

8. The pelvis remedial seating device as set forth in claim 1, wherein the pair of air bags are comprised of front/rear cells having an individual space; the air injection means is comprised of an air pump connected to the right/left air bag for supplying the air into the front/rear cells right/left direction control valves for supplying air to all air bags an air pressure sensor for detecting the pressure of the air fed into the right/left direction control valves from the air pump, right/left front/rear air discharge valves for discharging the air from the front/rear cells controller for controlling the air pump, direction control valves and air discharge valves, a display panel for displaying a signal generated from the controller, and a control panel having a plurality of operating keys for inputting the signal generated by a pushed key into the controller.

9. The pelvis remedial seating device as set forth in claim 8, wherein the seat cushion has further a photo detective sensor, and when the seat cushion is unoccupied, the photo detective sensor senses light and running of the remedial seated device is stopped by command of the controller.

10. The pelvis remedial seating device as set forth in claim 9, wherein the seat has a hollow formed by plural partitions in a round edge belt, and the hollow accommodates the air injection means, the photo detective sensor, the far-infrared generator "I", the oscillating motor "M" and the low frequency oscillator "F".

11. The pelvis remedial seating device as set forth in claim 8, wherein the seat cushion has further a far-infrared generator "I" controlled by command of the controller at the contacting portion with an occupant's hip, by which the far-infrared light is applied to a pelvis muscle.

12. The pelvis remedial seating device as set forth in claim 11, wherein the seat has a hollow formed by plural partitions in a round edge belt, and the hollow accommodates the air injection means, the photo detective sensor, the far-infrared generator "I", the oscillating motor "M" and the low frequency oscillator "F".

13. The pelvis remedial seating device as set forth in claim 8, wherein the seat cushion has further an oscillating motor "M" and a low frequency oscillator "F" which are under a control of the controller so as to stimulate an occupant's hip.

14. The pelvis remedial seating device as set forth in claim 8, wherein the seat has a hollow formed by plural partitions in a round edge belt, and the hollow accommodates the air injection means, the photo detective sensor, the far-infrared generator "I", the oscillating motor "M" and the low frequency oscillator "F".

15. The pelvis remedial seating device as set forth in claim 8, wherein the display panel is comprised of a timer unit for indicating running duration of the remedial device, a level indicating unit for displaying the level of a chosen function and a function indicating unit for displaying which function an occupant chooses.

16. The pelvis remedial seating device as set forth in claim 8, wherein the control panel is comprised of plural function key pads for selecting a function from various modes including massage, beat and fumble with pressing; a pair of level key pads for setting the level of a function chosen; plural mode key pads for choosing various mode; a time set key pad for setting duration of the chosen function or the mode; and a power key pad for turning on/off power.

* * * * *